United States Patent [19]

Dillon

[11] Patent Number: 4,468,007

[45] Date of Patent: Aug. 28, 1984

[54] OXY CUTTING TORCH

[76] Inventor: Nicholas T. E. Dillon, 10 East St., Magill, State of South Australia, Australia

[21] Appl. No.: 503,870

[22] Filed: Jun. 13, 1983

[30] Foreign Application Priority Data

Jun. 15, 1982 [AU] Australia ..... PF4431

[51] Int. Cl.[3] ..... B23K 7/00

[52] U.S. Cl. ..... 266/48

[58] Field of Search ..... 266/48

[56] References Cited

U.S. PATENT DOCUMENTS 1,644,157 10/1927 Smith ..... 266/48

1,955,120 4/1934 Fausek et al. ..... 266/48

3,948,496 4/1976 Miller ..... 266/48

*Primary Examiner*—W. Stallard

*Attorney, Agent, or Firm*—Brown & Martin

[57] ABSTRACT

Oxygen and acetylene are mixed in a mixing chamber of relatively large cross-sectional area, and are then passed through an elongate passage where they develop stream lines of flow, the mixture then passing through a plurality of elongate nozzle apertures arranged in a circular pattern around a central oxygen aperture in the nozzle, the nozzle apertures converging in a downstream direction such that their projections all intersect the projection of the central oxygen aperture at a single convergence point.

4 Claims, 2 Drawing Figures

OXY CUTTING TORCH

This invention relates to a torch which is used for the oxy cutting of metal.

BACKGROUND OF THE INVENTION

The usual oxy cutting torch which is presently employed in industry utilises a nozzle having a central orifice through which oxygen passes, surrounded by a first row of orifices through which a combustible mixture of oxygen and acetylene gas flows, itself still further surrounded by a further row of outer apertures which will contain further oxygen. The combustible gases are mixed internally within the torch with much turbulence to assure thorough mixing, and this turbulent gas issues in small paralleljets. This co-operates with a turbulent oxygen stream which issues from a central oxygen jet within the combustible gas flame, and when excess oxygen is present, metal to be cut is burned.

One of the characteristics of this type of cutting torch is the presence of very turbulent gas at the cutting zone, this resulting in a rough cut surface and also in much burning of the parent metal, but this latter feature is most undesirable since quite often it is important that the edge should be as clean as possible.

In Australian Pat. No. 460,066, the applicant herein disclosed a welding torch attachment having its mixing chamber length at least eight times its diameter, and that diameter at least three times the nozzle aperture diameter. The attachment described in that Patent has proved commercially successful, mainly for the reason that the flame burns non-turbulent gases, resulting in a high temperature over a smaller area. This phenomenon has made it possible to weld metals which are not otherwise readily weldable.

One object of this invention is to provide improvements which will reduce the burning of the parent metal in an oxy cutting torch, and to take advantage of the high temperature concentrated heat available from the burning of non-turbulent gases.

BRIEF SUMMARY OF THE INVENTION

In this invention, oxygen and acetylene are mixed in a mixing chamber of relatively large cross-sectional area, and are then passed through an elongate passage where they develop stream lines of flow, the mixture then passing through a plurality of elongate nozzle apertures arranged in a circular pattern around a central oxygen aperture in the nozzle, the nozzle apertures converging in a downstream direction such that their projections all intersect the projection of the central oxygen aperture at a single convergence point.

More specifically, the invention consists of an oxy cutting torch having a body, oxygen and acetylene fittings fixed with respect to the body and a nozzle on the downstream end of the body, walls defining an elongate passage within the body through which the oxygen and acetylene pass, and further walls defining a central passage through which oxygen passes when the torch is in use, said central passage opening into a central oxygen emitting aperture in the nozzle, said elongate passage opening into a plurality of elongate combustible gas emitting apertures in the nozzle, said combustible gas emitting apertures converging in a downstream direction such that the projections of the central axes all intersect the projection of the central axis of the central oxygen emitting aperture at a single convergence point.

By utilising this arrangement, the heat for cutting is far more concentrated than with a turbulent type flame, and in one example 500 mm of mild steel 12 mm thick was cut in a period of 1 minute, had a very clean cut surface, and sharp edges both on top and below the plate. The burning was so slight that the slag was easily removed, and the heat imparted to the plate was much less than with prior art torches. Gas usage was also considerably less, and in the example referred to above, the cut was achieved with 2 cubic feet of acetylene gas at 2 p.s.i. (14 kPa) compared with gas usage in a prior art cutting torch of 10 cubic feet at 15 p.s.i., while the oxygen usage was 18 cubic feet of gas at 20 p.s.i. (140 kPa) compared with prior art torch requirements of 80 cubic feet of gas at 40 p.s.i. Thus, even though cutting speed was fast, gas consumption was less than one quarter of the consumption in a turbulent flame type of oxy cutting torch.

Another advantage which is noted with the arrangement described above was that there was so much less cutting oxygen in the combustible mixture that once a neutral flame was established, the addition of the cutting oxygen was found to make only a trivial difference to the gas balance of that flame. This in turn had the additional advantage that the metal was evenly heated without excessive oxygen being applied to the surface, and the carbon dioxide and water vapour released upon combustion provided an enveloping gas surface which appeared to be responsible for the inhibition of excessive oxidation excepting at the location of the cut itself.

BRIEF DESCRIPTION OF THE DRAWINGS

An embodiment of the invention is described hereunder in some detail with reference to, and is illustrated in, the accompanying drawings, in which.

Figure 1:
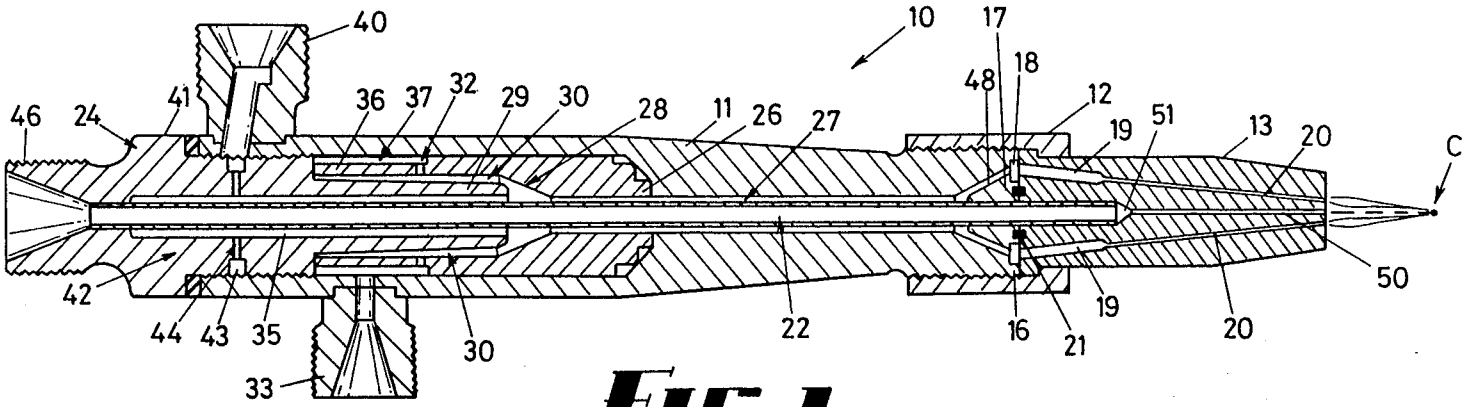
FIG. 1 is a central section through a torch.
Figure 2:
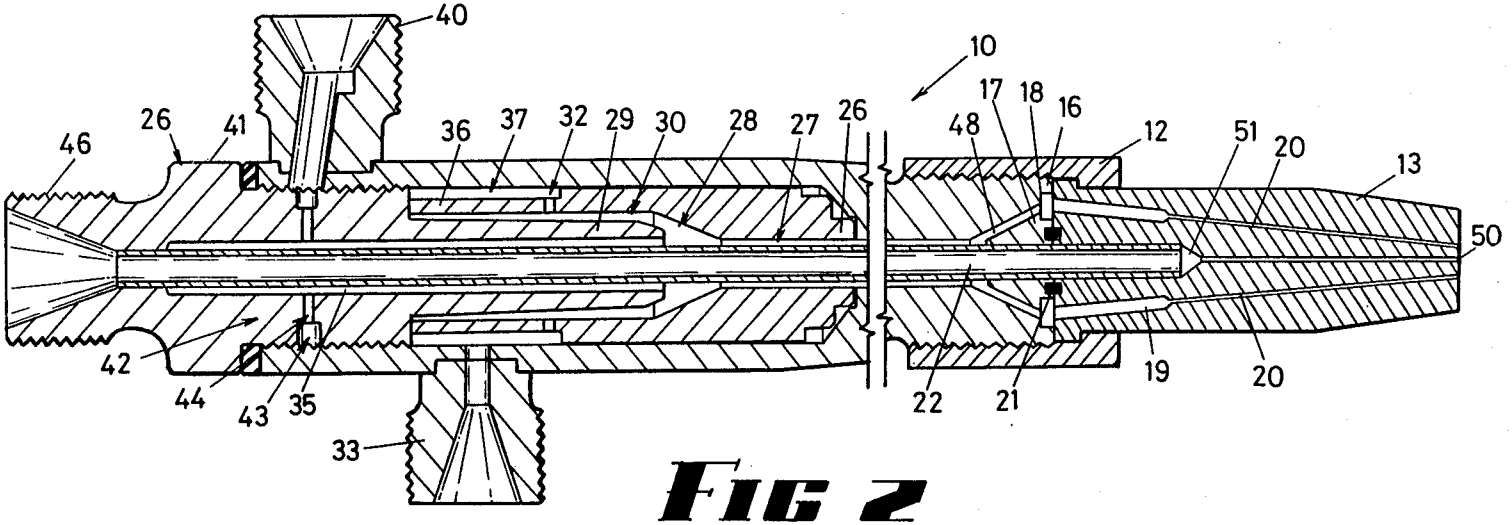
FIG. 2 is a similar section but fragmentary and drawn to an enlarged scale to more clearly show details of shape.

In this embodiment an oxy cutting torch 10 comprises an outer body 11, onto the downstream end of which is screwed a retainiing nut 12, the retaining nut retaining a cutting nozzle 13 in firm engagement with the end of the body 11. The downstream end of the body 11 is provided with two annular ridges which are spaced apart to define an annular groove 18 into which a number of apertures 19 open, the apertures 19 being relatively large diameter upstream openings which open into relatively small diameter nozzle apertures 20 from which combustible gas mixtures are emitted. The body is also provided with an inner annular groove, the inner annular groove being of such shape and size that its walls compress an "O" ring 21 about the outer surface of a parallel wall tube 22 which defines a central passage which extends through the centre of the body 11 and into the centre of the nozzle 13.

The central tube 22 is retained in place by an externally threaded end member 24 which threadably engages an internal thread within the body 11, entering the body from the upstream end, opposite the nozzle 13. A spacer member 25 abuts the end member 24, and is provided with a projection 26 at its downstream end which neatly engages in a complementary recess in the body 11, restraining flow of gas rearwardly past the thread. Although not shown herein, the spacer member 25 can threadably engage body 11. It has a central aperture 27 passing through it which is of larger diameter than the central tube 22 to define therewith an annular space which performs the function of a passage for the flow and mixing of the combustible gases. The upstream end of the spacer member 25 is provided with a counter-bore portion 28 of the central aperture 27, and this accepts a forwardly tapered hollow spigot 29 of the threaded end member 24. This spigot 29 and the walls of the counter-bore portion 28 define between them an intermediate annular space 30 which increases in cross-sectional area in a downstream direction, and which accepts acetylene gas part way along its length through a plurality of radially extending small apertures 32 through the annular upstream end of the spacer member 25, from the acetylene inlet fitting 33.

The spigot 29 is hollow and the central aperture through the spigot is also of larger diameter than the central tube so that an inner space 35 extends to the annular space between tube 22 and the wall of aperture 27. There is a reduced diameter tail 36 on the spacer member 25 which surrounds the spigot, and provides a third and outer concentric annular space 37 through which acetylene flows from the fitting 33 to the apparatus 32.

The body 11 is provided with an outwardly extending threaded hose fitting 40 to which an oxygen hose can be attached, and intermediate its ends it has a hexagonal portion 41 to which a spanner may be applied. Inwardly of the hexagonal portion is a threaded portion 42 which engages the threaded end of the body 11, and the threaded portion is interrupted part way along its length by an annular groove 43 having apertures 44 extending radially inwardly therefrom to the inner annular space 35. The inner annular space 35 however terminates in a coaxial threaded hose fitting 46, which is a second oxygen fitting, and the upstream end of the tube 22 is sealed to the fitting.

Oxygen which is introduced from the fitting 40 through the radial apertures 44 in the end member 24 and into the inner annular space 35 moves in a generally non-turbulent manner through the inner annular space 35 towards the nozzle 13. Acetylene is entrained into the oxygen stream, passing from fitting 33, through outer annular space 37 and apertures 32, through the intermediate annular space 30, past the end of spigot 29, and into the downstream annular space of counter-bore 28 into the central aperture 27 surrounding the tube 22. At the downstream end of the tube, the tube is sealed by the "O" ring 21 in the annular space at the nozzle end of the body 11, but apertures 48 extend outwardly both in a longitudinal and in a radial direction to terminate in the outer downstream annular groove 18 at the end of the body 11, and these are in gas flow communication with the coaxial apertures 19 and 20, which surround the oxygen emitting aperture 50, and which are inclined in the nozzle and directed towards one another so that the projection of these apertures terminate in a convergence point "C" external of the nozzle. Since each of these apertures comprises a relatively large diameter portion at its upstream end and a long relatively smaller diameter portion at its downstream end, it will emit a non-turbulent flow from the nozzle 13. The central oxygen emitting aperture 50 of the nozzle 13 is coaxial with the central axis of the tube, extends from a conical end wall 51 in the nozzle to the outer end of the nozzle. The cone angle of the wall 51 is between 150 degrees and 170 degrees, it being found that this cone angle interferes only to a very small degree with the generally non-turbulent flow of the oxygen through the central tube. The tube 22, and the elongate passage defined between it and the walls of aperture 27, are both long with respect to cross-sectional area, such that gas flow therein is streamlined. The nozzle apertures 20, and the central oxygen emitting aperture 50, are also long for the same reason, in each case the length exceeding three hundred times the diameter. This configuration greatly assists in ensuring that the emitted gases are non-turbulent (provided pressure is low).

Separate controls (not shown) are provided for the flame oxygen, the cutting oxygen, and the acetylene, and the arrangement is such that a neutral flame can be first established by careful adjustment of the flame oxygen and acetylene controls, and cutting oxygen can be introduced with very little interference with the mixture in the flame jets. That is, it is possible to quite easily arrange for the gas surrounding the heater zone to be quite neutral such that it does not excessively oxidize the surface of the metal being cut.

Owing to the excellent combustion conditions provided by this torch, and to the relatively non-turbulent flow of both the flame gases and the cutting oxygen, it is possible for the cutting oxygen outlet aperture to be very small in diameter (in this embodiment about 0.050 inches or 1.1 mm) and this provides very small diameter and highly concentrated heat for cutting purposes.

I claim:

1. An oxy cutting torch having a body, oxygen and acetylene fittings fixed with respect to the body and a nozzle on the downstream end of the body, an end member at the upstream end of the body, said oxygen fitting being on said end member, a tube extending from said end member through the body to said nozzle and defining a central passage through which oxygen passes when the torch is in use, a spacer member within the body between said end member and said nozzle, the spacer member surrounding said tube and defining therebetween an annular elongate passage which extends part way through the end member and the body and through which oxygen and acetylene pass, said central passage opening into a central oxygen emitting aperture in the nozzle, said elongate passage opening into a plurality of elongate combustible gas emitting apertures in the nozzle, said combustible gas emitting apertures converging in a downstream direction such that the projections of their central axes all intersect the projection of the central axis of the central oxygen emitting aperture at a single convergence point.

2. An oxy cutting torch according to claim 1, wherein said fittings include a second said oxygen fitting and an acetylene fitting both of which extend from the body, and apertures respectively in the end member and the spacer member form parts of conduit spaces between said fittings and said elongate annular passage.

3. An oxy cutting torch having a body, a nozzle at the downstream end of the body, an end member at the upstream end of the body, a spacer member abutting an inner wall of the end member and housed within the body, a first oxygen fitting on the end member in gas flow communication with an elongate tube which extends through the body to the nozzle and defines a central passage, and an oxygen emitting aperture through the nozzle coaxial with, and in gas flow communiction with, the central passage, a central aperture extending through the spacer member, part way through the end member and part way through the body and defining an elongate passage, apertures through the end member placing said second oxygen fitting into gas flow communication with said elongate passage and apertures through the spacer member placing said acetylene fitting into gas flow communication with said elongate passage, a plurality of small diameter nozzle apertures surrounding said oxygen emitting aperture and opening into an annular groove between said nozzle and body, and further apertures placing said elongate passage into gas flow communication with said annular groove.

4. An oxy cutting torch according to claim 3, wherein said nozzle apertures open at their upstream ends into respective relatively large diameter upstream openings which themselves open into said annular groove.

* * * * *